US005449972A

United States Patent [19]

Gregory

[11] Patent Number: 5,449,972

[45] Date of Patent: Sep. 12, 1995

[54] LOW-TORQUE MAGNETRON TUNING DEVICE

[75] Inventor: Tommy F. Gregory, Trout Run, Pa.

[73] Assignee: Litton Systems, Inc., Beverly Hills, Calif.

[21] Appl. No.: 99,840

[22] Filed: Jul. 30, 1993

[51] Int. Cl.[6] ..... H01J 23/213; H01J 25/50

[52] U.S. Cl. ..... 315/39.610; 331/90

[58] Field of Search ..... 315/39.51, 39.55, 39.61; 331/90

[56] References Cited

U.S. PATENT DOCUMENTS

| | | | |
|---|---|---|---|
| 3,187,220 | 6/1965 | Dench | 315/39.55 |
| 3,441,794 | 4/1969 | Chun | 315/39.61 |
| 3,441,795 | 4/1969 | Hynes et al. | 315/39.61 |
| 3,876,903 | 4/1975 | Landau | 315/39.55 X |
| 4,234,855 | 11/1980 | Busacca et al. | 315/39.61 X |
| 4,247,828 | 1/1981 | Busacca et al. | 315/39.61 X |
| 4,313,091 | 1/1982 | Busacca et al. | 315/39.61 X |
| 4,527,094 | 7/1985 | Gerard et al. | 315/39.55 |
| 4,531,104 | 7/1985 | Schaeffer | 331/90 |

OTHER PUBLICATIONS

Microwave Tubes by A. S. Gilmour, Jr. (Artech House, 1986), Chapter 13.2.7, "Magnetron Tuning".

*Primary Examiner*—Benny T. Lee

*Attorney, Agent, or Firm*—Graham & James

[57] ABSTRACT

A low-torque tuning apparatus is provided for use in a magnetron having an electron emitting cathode coaxially disposed within an anode cavity. The tuning apparatus includes a tuner drive capable of reciprocating axial movement relative to the magnetron. The tuner drive has a plate forming a portion of the cavity such that periodic changes in position of the plate by movement of the tuner drive alter a resonant characteristic of the cavity. Axial movement of the tuner drive is guided by a diaphragm at a first portion of the tuner drive and a double bellows at a second portion of the tuner drive. The diaphragm and double bellows have a first spring bias which permits the axial movement while precluding radial movement of the tuner drive and tends to return the tuner drive to a generally null position relative to the magnetron. The double bellows further provides a vacuum seal between the cavity and an atmosphere external to the magnetron. The tuner drive is linked by a leaf spring to an external driving force which inducing the reciprocating axial movement into said tuner drive. The leaf spring has a second spring bias. A total amount of torque required by the external driving force to move the plate is substantially reduced by cancellation of the first and second spring biases over a majority of range of motion of the tuner drive.

24 Claims, 4 Drawing Sheets

FIG. 1a
PRIOR ART
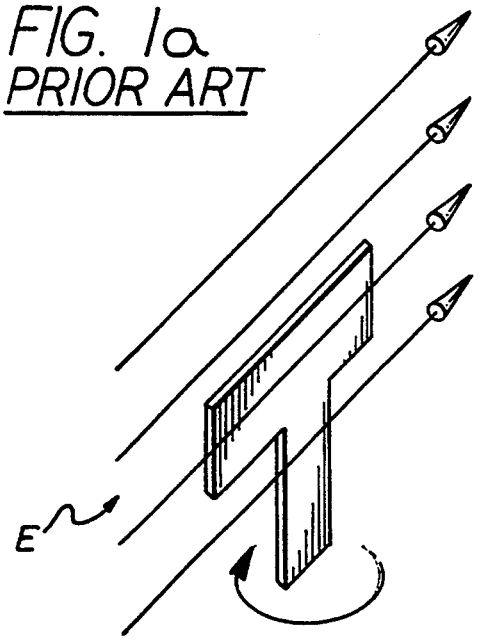
FIG. 1b
PRIOR ART
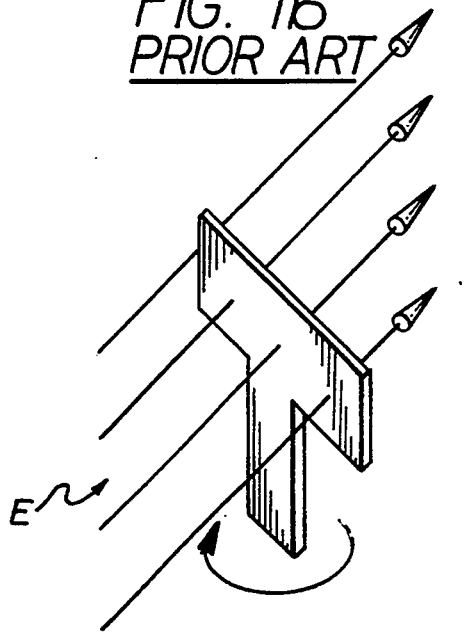
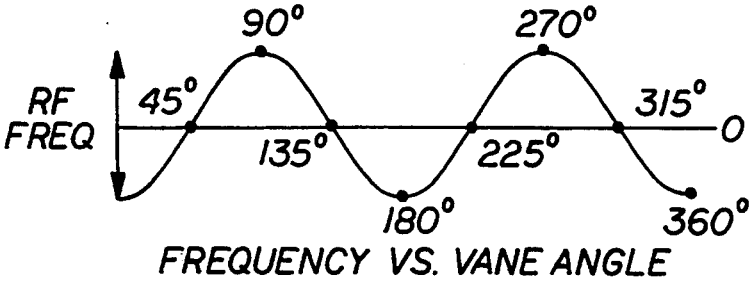
FIG. 2
PRIOR ART
FIG. 3
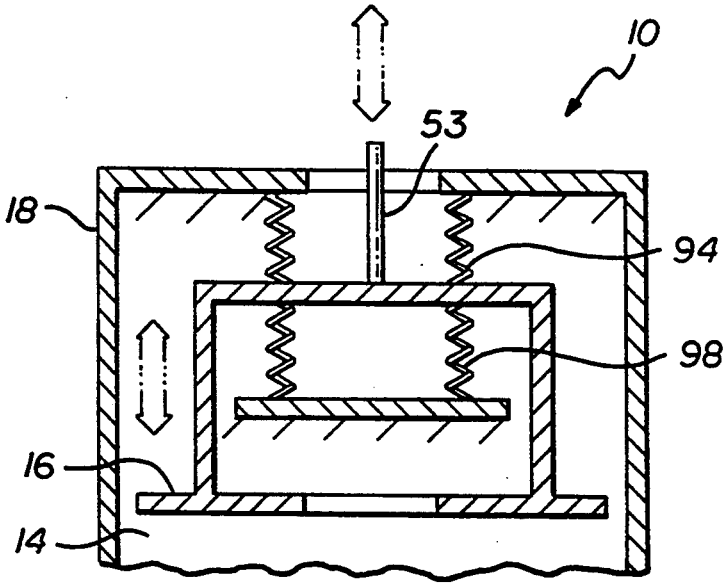

LOW-TORQUE MAGNETRON TUNING DEVICE

BACKGROUND OF THE INVENTION

1. Field of the Invention

The present invention relates to frequency agile magnetrons, and more particularly, to a novel low-torque tuning mechanism for changing the frequency of a magnetron.

2. Description of Related Art

Crossed-field tubes, such as magnetrons, are commonly used to generate RF or microwave electromagnetic energy for assorted applications including radar. The magnetron commonly has a cylindrically shaped cathode coaxially disposed so as to be surrounded by a plurality of radially extending anode vanes. The space between the cathode surface and the anode provides a cavity, and a potential is applied between the cathode and the anode forming an electric field in the cavity. A magnetic field is also provided in the cavity perpendicular to the electric field. Electrons are emitted thermionically from the cathode surface and are caused to orbit around the cathode in the cavity due to the magnetic field, during which they interact with an RF wave moving on the anode. The electrons give off energy to the moving RF wave, thus producing a high power microwave output signal.

It is useful to provide a magnetron having a frequency which can be periodically changed or tuned, known as a "frequency agile" magnetron. Frequency agile magnetrons produce an output signal which is less susceptible to jamming, and which provides a higher quality radar image due to the assortment of microwave wavelengths emitted. Many techniques are used for tuning magnetrons, and typically employ changes in the capacitance or the inductance of the magnetron cavity. An example of a prior art tuning device for a coaxial magnetron is found in U.S. Pat. No. 4,531,104 for TUNABLE MAGNETRON OF THE COAXIAL-VACUUM TYPE, which issued Jul. 23, 1985 by Schaeffer.

Another prior art magnetron tuning technique involves the insertion of rotatable dielectric paddles into the cavity. The paddles have a generally planar surface which is caused to rotate by interaction with a high speed gear train driven by an external motor. The instantaneous position of the paddles relative to the electric field effects the frequency of the magnetron. When the planar surface of the paddles is generally parallel to the electric field E, as illustrated in FIG. 1*a*, the magnetron frequency is a minimum. Conversely, when the planar surface of the paddles is generally perpendicular to the electric field E, as illustrated in FIG. 1*b*, the magnetron frequency is a maximum. As the paddles rotate within the cavity, the magnetron frequency alternates sinusoidally between the minimum and maximum value, as illustrated in FIG. 2. For each full rotation of the paddles, two complete cycles of the magnetron tuning range are achieved.

This type of magnetron tuning has numerous advantages in achieving frequency agility. Since the tuner mechanism is a rotating device, the required motor power can be kept to a minimum since it must only supply enough power to overcome windage and frictional losses once normal rotational speeds are reached. Moreover, the doubling effect of the tuning cycle provides that the motor and gear train only have to rotate at half the frequency of other tuning mechanisms.

However, the mechanical rotation of the dielectric paddles within the cavity presents additional problems which reduce the operational life of the magnetrons. The gear train assembly creates a certain amount of debris consisting of a complex mixture of lubricants, metal dust, and the pressurizing gas. This debris can be deposited on the surface of the dielectric paddles and drastically alter magnetron operation. First, the debris changes the dielectric properties of the paddles and alters the tuned range of frequencies produced by the magnetron. Second, the risk of arcing between the paddles and the cathode is increased due to the reduced voltage standoff capability of the paddles. Third, there is reduced power output or excessive power variation from the magnetron by the debris changing the resonant characteristics of the anode cavity. Finally, in certain catastrophic cases, moding or missing pulses caused by changes in anode cavity properties can result.

Alternative methods of magnetron tuning which attempt to avoid the problems experienced with the method discussed above, have included the use of a moveable end plate within the cavity which changes the resonant characteristics of the cavity in order to change the inductance of the cavity. The end plate is connected via a rod to a crankshaft arrangement which translates rotational motion of a motor into axial movement of the end plate. Reciprocating motion of the end plate can sinusoidally tune the magnetron frequency. However, this technique shares many of the drawbacks of the prior technique in that it relies heavily on rigid mechanical linkages which require lubrication and generate debris. The mechanical linkages tend to wear over the life of the magnetron, which alters the tuned frequency range. Further, increasing amounts of torque must be produced by the motor to overcome the degradation of the mechanical linkages, which decreases the operational life of the motor.

Accordingly, it would be desirable to provide a technique for magnetron tuning that provides reliable operation without the generation of undesired debris within the anode cavity or the need for excessive torque to operate the moveable tuning member.

SUMMARY OF THE INVENTION

In accordance with the teachings of this invention, a low-torque tuning apparatus for use in a magnetron is provided. The magnetron has an electron emitting cathode coaxially disposed within an anode cavity. The tuning apparatus includes a tuner drive capable of reciprocating axial movement relative to the magnetron. The tuner drive has a plate forming a portion of the cavity such that periodic changes in position of the plate by movement of the tuner drive alters a resonant characteristic of the cavity.

Axial movement of the tuner drive is guided by a diaphragm at a first portion of the tuner drive and a double bellows at a second portion of the tuner drive. The diaphragm and double bellows have a first spring bias which permits axial movement while precluding radial movement of the tuner drive and tends to return the tuner drive to a generally null position relative to the magnetron. The double bellows further provides a vacuum seal between the cavity and an atmosphere external to the magnetron. The tuner drive is linked by a leaf spring to an external driving force which induces the reciprocating axial movement into said tuner drive.

The leaf spring has a second spring bias. A total amount of torque required by the external driving force to move the plate is substantially reduced by cancellation of the first and second spring bias over a majority of range of motion of the tuner drive.

In an embodiment of the present invention, the external driving force comprises a motor external to the magnetron for producing a rotational motion, and a crankshaft for converting the rotational motion into the reciprocating axial motion. The relative position between the crankshaft and the tuner drive can be adjusted to vary the range of motion of the tuner drive. More particularly, the crankshaft receives the rotational motion and has a crank arm offset from an axle of the motor. A yoke engages the crank arm and connects to the leaf spring. The rotational motion of the crankshaft is converted to a circular motion of the yoke.

Alternatively, the present invention further provides for adjustment of the relative position between the yoke and the tuner drive. The adjustment apparatus comprises a bearing mount disposed between the yoke and the crank arm and has a cam surface. A screw engages the bearing mount and has an exposed portion accessible from external to the yoke. Rotation of the screw induces rotation into the bearing mount relative to the yoke to alter a position of the crank arm within the yoke.

A more complete understanding of the low-torque magnetron tuner will be afforded to those skilled in the art, as well as a realization of additional advantages and objects thereof, by consideration of the following detailed description of the preferred embodiment. Reference will be made to the appended sheets of drawings which will be first described briefly.

BRIEF DESCRIPTION OF THE DRAWINGS

FIG. 1*a* is a side view of a prior art dielectric paddle disposed within a magnetron cavity;

FIG. 1*b* is a side view of the prior art dielectric paddle of FIG. 1*a* rotated by 90 degrees;

FIG. 2 is a graph depicting a relationship between rotational position of the prior art dielectric paddle and the resonant frequency of the magnetron cavity;

FIG. 3 is a sectional side view of a magnetron double bellows configuration;

DETAILED DESCRIPTION OF THE PREFERRED EMBODIMENT

The present invention provides a tuning apparatus for a magnetron that enables reliable frequency agile operation without the generation of undesired debris within the anode cavity or the need for excessive motor torque to operate the moveable tuning member.

Figure 4:
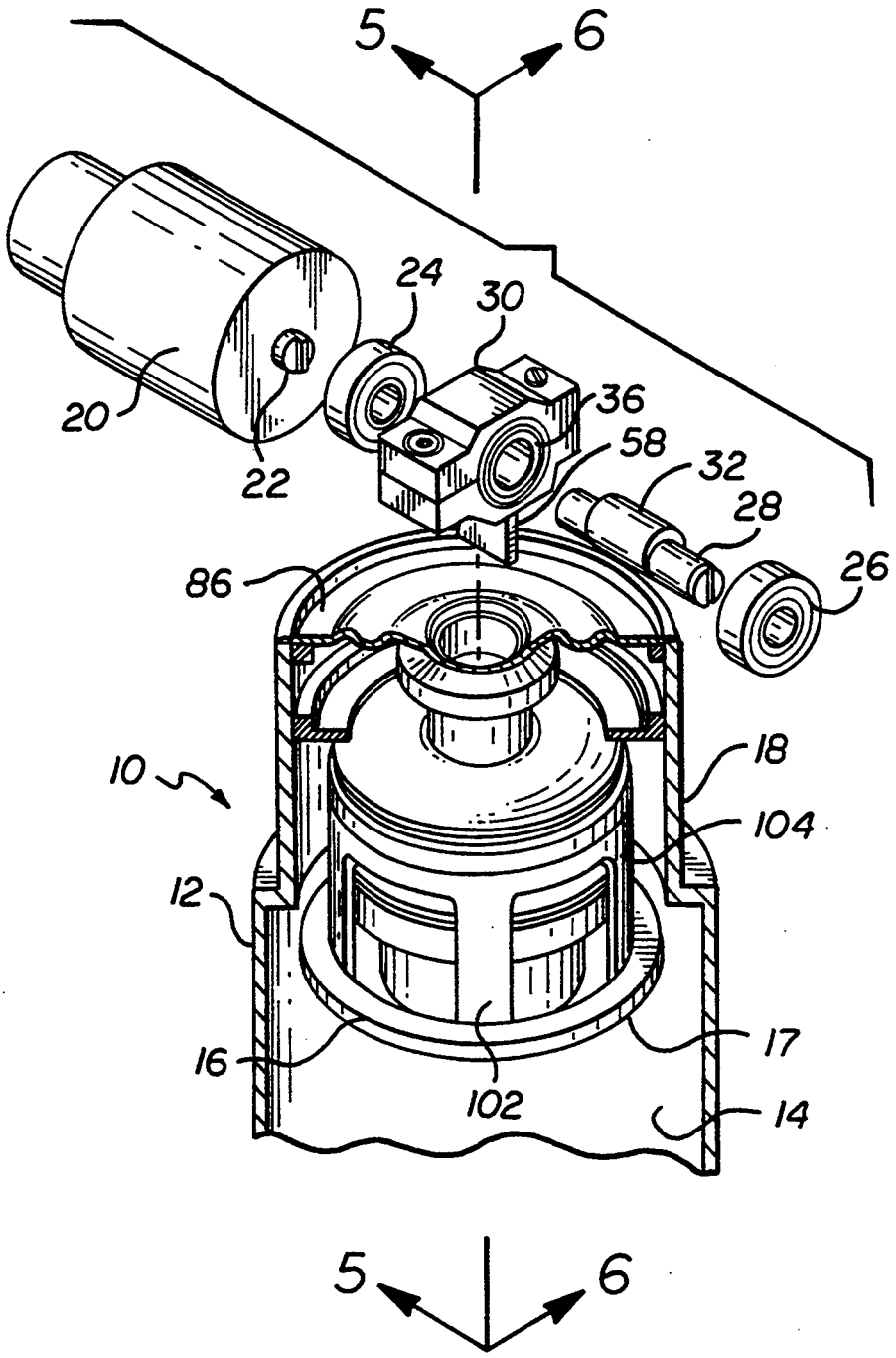
FIG. 4 is an exploded partial cross-sectional view of a magnetron tuning apparatus of the present invention.

Referring now to FIG. 4, a low-torque tuning apparatus for use with a magnetron 10 is illustrated. The magnetron 10 is disposed within an external housing 12 having a collar portion 18 which extends from an upper portion of the housing. As will be further described below, the tuning apparatus of the present invention extends into the housing 12 from external to the housing through the collar portion 18. The coaxial type of magnetron 10 includes a cavity 14, which is illustrated as an internal portion of the housing 12. As known in the art, the volume of the cavity 14 within the magnetron 10 determines the resonant characteristics of the magnetron, and the operating frequency of the magnetron.

A tuner disk 16 defines a top surface 17 of the cavity 14. The tuner disk 16 can be periodically manipulated in an axial direction relative to the magnetron cavity 14 in order to alternatingly compress and expand the cavity volume. In so doing, the inductance of the cavity is altered, resulting in sinusoidal variations of the resonant frequency of the magnetron 10, similar to that described above with respect to FIG. 2.

The periodic manipulation of the tuner disk 16 is regulated and controlled by an external motor generator 20. The motor generator 20 has an axle 22 which rotates at a predetermined velocity. The axle 22 links to a crankshaft 28 having a crank arm 32 offset a predetermined magnitude from a center line of the axle 22 and crankshaft 28. In an embodiment of the present invention, the magnitude of the offset is approximately 0.009 inches. The crankshaft 28 is guided and secured by crank bearings 24 and 26. As known in the art, the crank bearings are sealed with internal lubricant for long life usage with minimal outgassing of lubricant material. The crank arm 32 extends through a bearing 36 disposed within a yoke 30 (see also FIG. 5). The yoke 30 is a generally rectangular member which oscillates in a generally circular pattern upon interaction with the rotating crankshaft 28.

Figure 5:
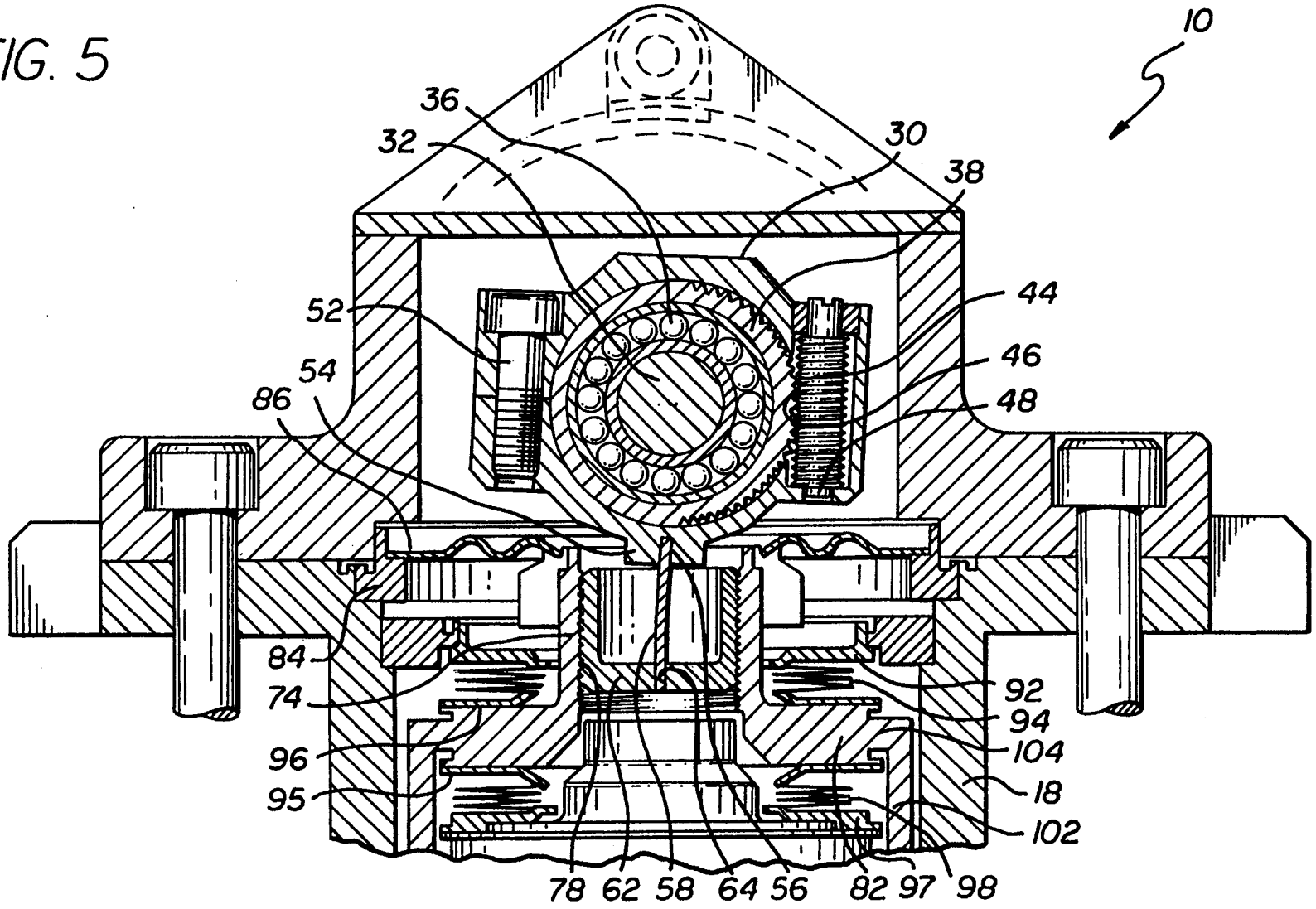
FIG. 5 is a sectional front view of the magnetron tuning apparatus as taken through the section 5—5 of FIG. 4.
Figure 6:
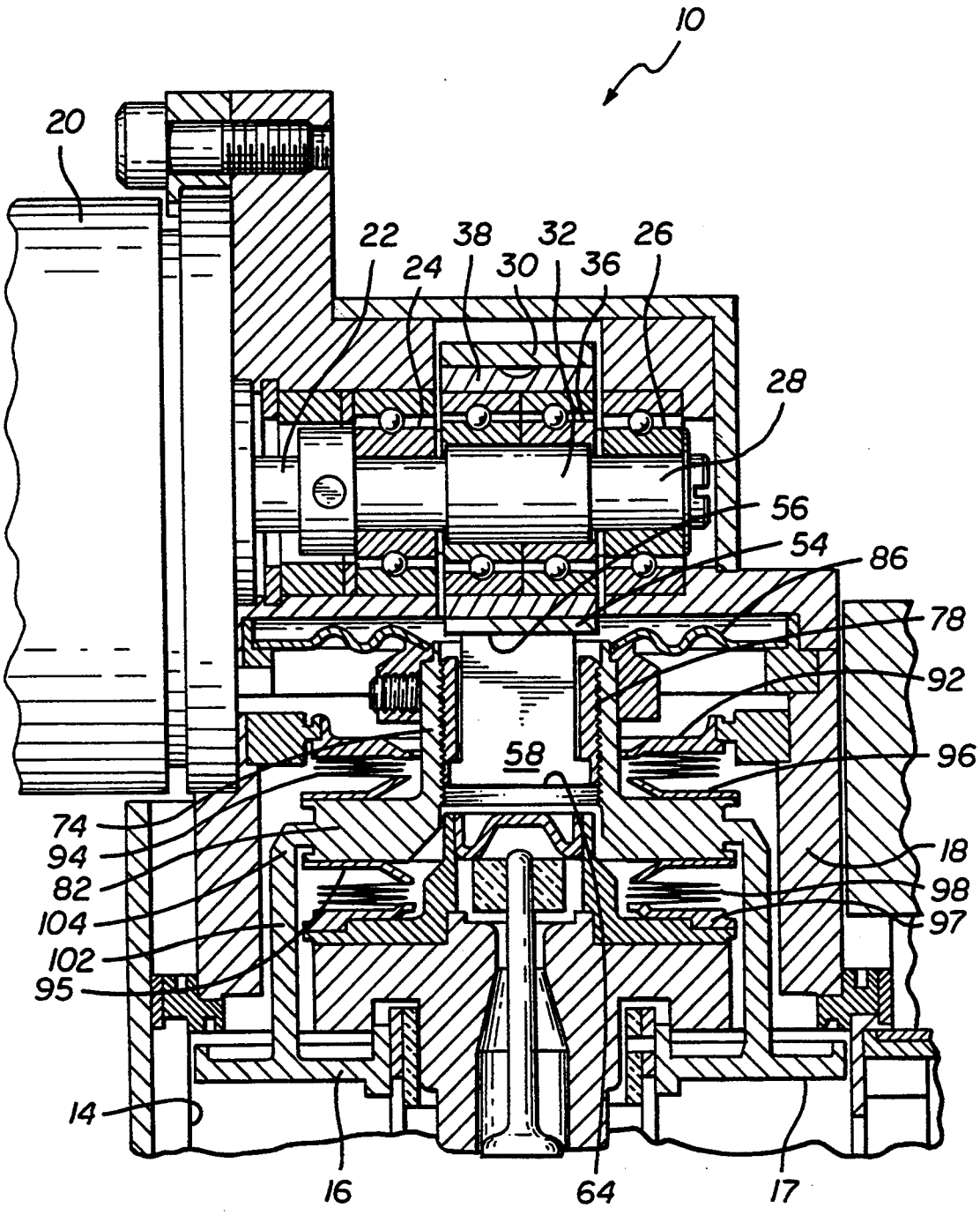
FIG. 6 is a sectional side view of the magnetron tuning apparatus as taken through the section 6—6 of FIG. 4.

In an embodiment of the present invention, the yoke 30 has an internal adjusting mechanism which permits the adjustment of the distance between the yoke and the magnetron 10. In FIGS. 5 and 6, a bearing mount 38 is illustrated disposed between the bearing 36 and the yoke 30, and having a cam shape. The bearing mount 38 has gear teeth extending outwardly from a circumferential portion of the mount. As illustrated in FIG. 5, an adjusting screw 44 extends into a side portion of the yoke 30 and has threads 46 which mesh with the gear teeth of the bearing mount 38 and a bottom end 48. A screwdriver slot may be found in the top of the adjusting screw 44 to provide for easy rotation of the screw. Rotation of the adjusting screw 44 causes rotation of the bearing mount 30 which changes the relative position of the bearing 36 within the yoke 30. The yoke 30 is assembled from a top and a bottom portion, and a clamp screw 52 is disposed at an opposite side of the yoke from the adjusting screw 44 and serves to hold the yoke portions together.

At a lower portion of the yoke 30, a leaf spring guide 54 is disposed, illustrated in FIGS. 5 and 6. The leaf spring guide 54 has a pair of depending side walls which define a groove 56 therebetween. The groove 56 is dimensioned to receive a leaf spring 58. The leaf spring 58 is formed of a generally flexible material, such as metal, having a width approximately equivalent to that of the yoke 30 and a relatively small thickness. As will be further described below, the leaf spring 58 provides a mechanical linkage between the oscillating yoke 30 and the tuner disk 16, as illustrated in FIG. 4. The end of the leaf spring 58 is fixedly secured in the groove 56 by brazing or other known welding technique.

As illustrated in FIGS. 5 and 6 leaf spring 58 engages a threaded cup 62 (FIG. 5 only) disposed within the collar portion 18 of the magnetron 10. The threaded cup 62 (FIG. 5 only) has cylindrical outer walls and a circular base portion having a receiving groove 64 for engagement with an opposite end of the leaf spring 58 from the end which engages the groove 56. The threaded cup 62 (FIG. 5 only) threadingly engages a drive member 74, which comprises an upper cylindrical portion having threads 78 on an inside diameter for engaging the outer threads of the threaded cup 62 (FIG. 5 only). The drive member 74 also has a lower annular shaped portion 82 which structurally supports the tuner disk 16 (see FIG. 6). A plurality of legs 102 extend from an outer circumferential portion 104 of the annular member 82 and extend axially towards the cavity 14 of the magnetron 10 (see also FIG. 4). The legs 102 engage the disk 16 (FIG. 6 only) to mechanically link the drive member 74 with the disk.

The threaded cup 62 (FIG. 5 only) the drive member 74, the legs 102, and the tuner disk 16 (FIG. 6 only) are assembled together and operate as a single unit, referred to herein as the tuner drive. As such, the tuner drive is moveable in the axial direction, yet it is generally rigid in the radial direction. The tuner drive pivots from the collar portion 18 at an upper portion and at a lower portion, which provides pivot points. At the upper portion of the drive member 74, a diaphragm 86 is disposed which connects the drive member to the collar portion 18 at a flange 84 (see also FIG. 4). The diaphragm 86 is a thin, annular shaped member which includes a plurality of pleats. The diaphragm 86 is formed from a generally flexible material, such as metal, which flexes to enable axial movement of the drive member 74. The pleats tend to facilitate the flexing of the diaphragm 86 in the axial direction.

At the lower portion of the drive member 74, a first and a second bellows portion 94 and 98 are provided. The upper bellows 94 and the lower bellows 98 include a plurality of annular shaped members similar to the diaphragm 86, which are alternatingly joined at an outer circumferential portion and at an inner circumferential portion. The upper bellows 94 is disposed above the annular member 82 of the drive member 74, and is secured at a first end of the bellows to a vacuum weld ring 92 fastened to an internal portion of the collar 18, and at a second end of the bellows to a weld bracket 96 fastened to the top of the annular member 82. The lower bellows 98 is secured at a first end to a bracket 95 attached to the underside of the annular member 82, and at a second end of the bellows to an end plate 97.

The upper and lower bellows portions 94 and 98 (collectively referred to as a double bellows) contribute to the axial flexibility and radial rigidity of the tuner drive. Moreover, the double bellows provides a vacuum seal for the magnetron 10. Operation of the double bellows is illustrated in FIG. 3. The cavity 14 of the magnetron 10 is normally operated with a vacuum formed therein, with the external portion of the magnetron generally exposed to the atmosphere. To prevent movement of the tuner drive due to pressure differential between the cavity 14 and the atmosphere, the first bellows portion 94 forms a seal between the atmosphere and the vacuum environment in the cavity. The second bellows portion 98 will expand while the first bellows portion 94 contracts in order to equalize the pressure differential. Thus, is shown in FIG. 3, as the tuner drive and tuner disk 16 rise relative to the collar 18 by upward force applied by the leaf spring 58, the upper bellows 94 contracts to facilitate the upward movement, and the lower bellows 98 expands to maintain equilibrium within the magnetron 10. Conversely, as the tuner drive 70 descends and tuner disk 16 descend relative to the collar 18 by downward force applied by the leaf spring, the upper bellows 94 expands to facilitate the downward movement, and the lower bellows 98 compresses to maintain equilibrium within the magnetron 10.

In operation, the crankshaft 28 rotates under operation of the motor generator 20. The rotation of the crankshaft causes a similar rotational motion of the yoke 30. The rotational motion of the yoke 30 is converted to a linear motion by the leaf spring 58. Rather than acting as a rigid linkage, the leaf spring 58 flexes due to its internal spring bias during the rotation of the yoke 30. Similarly, the diaphragm 86 and double bellows also flexes due to its internal spring bias during axial motion of the tuner drive. As will be explained below, the spring bias of the leaf spring 58 tends to cancel the combined bias of the diaphragm and double bellows, so that the torque required by the motor generator 20 can be minimized.

With the yoke 30 at the 0 degree position, or at top dead center, the leaf spring 58 would be fully extended without any flexure. Both the diaphragm 86 and the double bellows would be biased in an upward direction so that the tuner drive is at its highest point relative to the cavity 14. As the yoke 30 rotates towards the 90 degree position, the leaf spring 58 begins to flex against its bias. Although this flexure provides a negative force against the yoke 30 which impedes its rotation, the bias of both the diaphragm 86 and the double bellows tends to draw the tuner drive downward which counteracts the leaf spring force.

Once at the 90 degree position, flexure of the leaf spring 58 is at a maximum, but the diaphragm 86 and double bellows are now unbiased. The flexure of the leaf spring 58 applies a downward force against the tuner drive, which causes the diaphragm 86 and double bellows to begin to flex in the opposite direction, again counteracting the leaf spring force. At the 180 degree position, the leaf spring 58 has again returned to the unbiased position and the other spring members are now fully flexed to the downward position.

It should be apparent that the counteraction of spring force continues throughout the rotation of the yoke 30, such that at any given moment the two springs forces are opposed. Thus, the only torque required to rotate the yoke 30 is the internal friction of the motor 20 and the frictional forces of the crankshaft 28 and the bearings 24, 26 and 36. The absence of sliding linkages eliminates points which would wear out and change the tuning characteristics of the magnetron 10.

Having thus described a preferred embodiment of a low-torque magnetron tuning apparatus, it should now be apparent to those skilled in the art that the aforestated objects and advantages for the within system have been achieved. For example, the tuning apparatus described above can be adapted for use in any type mechanical device which utilizes periodic reciprocal movement of a member by use of rigid linkages. It should also be appreciated by those skilled in the art that various modifications, adaptations, and alternative embodiments thereof may be made within the scope and spirit of the present invention, which is further defined by the following claims.

What is claimed is:

1. A low-torque tuning apparatus for use in a magnetron having a cavity defined within a housing of the magnetron, the apparatus comprising:

a tuner drive capable of reciprocating axial movement relative to said magnetron and having a plate coupled thereto which defines a portion of said cavity such that periodic changes in position of said plate by movement of said tuner drive alter a resonant characteristic of the cavity;

guide means for guiding said axial movement of said tuner drive, said guide means comprising a first spring coupled to said tuner drive which permits said axial movement while precluding radial movement of said tuner drive;

flexible linkage means for linking said tuner drive to an external driving force, said flexible linkage means inducing said reciprocating axial movement into said tuner drive and comprising a second spring coupled between said tuner drive and said external driving force;

whereby, said first and second springs each respectively apply a bias force in opposite directions over a majority of a range of motion of said tuner drive such that said bias forces cancel and a total amount of torque required by said external driving force to move said plate is substantially reduced by cancellation of said first and second spring bias forces.

2. The tuning apparatus of claim 1, wherein said flexible linkage means further comprises a leaf spring.

3. The tuning apparatus of claim 1, wherein said guide means further comprises:

a diaphragm coupling a first portion of said tuner drive to said housing of said magnetron; and a bellows coupling a second portion of said tuner drive to said housing and providing a vacuum seal between said cavity and an atmosphere external to said magnetron.

4. The tuning apparatus of claim 1, further comprising:

motor means external to said magnetron for producing a rotational motion; and crankshaft means coupled between said motor means and said linkage means for converting said rotational motion into said reciprocating axial movement, wherein said motor means and said crankshaft means provide said external driving force.

5. The tuning apparatus of claim 4, wherein said crankshaft means further comprises:

a crankshaft receiving said rotational motion and having a crank arm offset from an axle of said motor means;

a yoke engaging said crank arm and connecting to said linkage means, said rotational motion of said crankshaft being converted to a circular motion of said yoke.

6. The tuning apparatus of claim 5, further comprising:

adjustment means coupled between said crank arm and said yoke for adjusting said range of motion of said tuner drive.

7. The tuning apparatus of claim 6, wherein said adjustment means further comprises:

a bearing mount disposed between said yoke and said crank arm and having a cam surface; and a screw engaging said bearing mount and having an exposed portion accessible from external to said yoke, said screw being capable of rotating said bearing mount relative to said yoke to alter a position of said crank arm within said yoke.

8. A low-torque tuning apparatus for use in a magnetron having a cavity defined within a housing of the magnetron, the apparatus comprising:

a tuner drive capable of reciprocating axial movement relative to said cavity and having a plate coupled thereto which defines a portion of said cavity such that periodic changes in position of said plate by movement of said tuner drive alter a resonant characteristic of the cavity;

a diaphragm coupling a first portion of said tuner drive to said housing and a bellows coupling a second portion of said tuner drive to said housing, said diaphragm and said bellows providing a first spring bias force which permits said axial movement while precluding radial movement of said tuner drive;

a leaf spring linking said tuner drive to an external driving force, said leaf spring inducing said reciprocating axial movement into said tuner drive and providing a second spring bias force;

whereby, said first spring bias force and said second spring bias force being in opposite directions over a majority of range of motion of said tuner drive so that a total amount of torque required by said external driving force to move said plate is substantially reduced by cancellation of said first and second spring bias forces.

9. The tuning apparatus of claim 8, wherein said bellows provides a vacuum seal between said cavity and an atmosphere external to said magnetron.

10. The tuning apparatus of claim 8, further comprising:

motor means external to said magnetron for producing a rotational motion; and crankshaft means coupled between said motor means and said leaf spring for converting said rotational motion into said reciprocating axial movement, wherein said motor means and said crankshaft means provide said external driving force.

11. The tuning apparatus of claim 10, further comprising:

adjustment means coupled to said crankshaft means for adjusting said range of motion of said tuner drive.

12. A low-torque tuning apparatus for use in a magnetron having a cavity, the apparatus comprising:

a tuner drive capable of reciprocating axial movement relative to said cavity and having a plate coupled thereto to define a portion of said cavity such that periodic changes in position of said plate by movement of said tuner drive alter a resonant characteristic of the cavity;

guide means for guiding said axial movement of said tuner drive, said guide means providing a first spring bias force on said tuner drive which permits said axial movement while precluding radial movement of said tuner drive;

a leaf spring flexibly linking said tuner drive to an external driving force, said leaf spring inducing said reciprocating axial movement into said tuner drive and providing a second spring bias force;

whereby, said first spring bias force and said second spring bias force being in opposite directions over a majority of range of motion of said tuner drive so that a total amount of torque required by said external driving force to move said plate is substantially reduced by cancellation of said first and second spring bias forces.

13. The tuning apparatus of claim 12, wherein said guide means further comprises:

a diaphragm coupled to a first portion of said tuner drive; and a bellows coupled to a second portion of said tuner drive.

14. The tuning apparatus of claim 13, wherein said bellows provides a vacuum seal between said cavity and an atmosphere external to said magnetron.

15. The tuning apparatus of claim 12, wherein said external driving force comprises:

motor means external to said magnetron for producing a rotational motion; and crankshaft means coupled between said motor means and said leaf spring for converting said rotational motion into said reciprocating axial movement.

16. The tuning apparatus of claim 15, wherein said crankshaft means further comprises:

a crankshaft receiving said rotational motion and having a crank arm offset from an axle of said motor means; and a yoke engaging said crank arm and connecting to said linkage means, said rotational motion of said crankshaft being converted to a circular motion of said yoke.

17. The tuning apparatus of claim 16, further comprising:

adjustment means coupled between said crankshaft and said yoke for adjusting said range of motion of said tuner drive.

18. The tuning apparatus of claim 17, wherein said adjustment means further comprises:

a bearing mount disposed between said yoke and said crank arm and having a cam surface; and a screw engaging said bearing mount and having an exposed portion accessible from external to said yoke, said screw being capable of rotating said bearing mount relative to said yoke to alter a position of said crank arm within said yoke.

19. A low-torque tuning apparatus, comprising:

a drive member capable of reciprocating axial movement and having a tuning plate;

guide means coupled to said drive member for guiding said axial movement of said drive member, said guide means providing a first spring bias force which permits said axial movement while precluding radial movement of said drive member;

a leaf spring flexibly linking said drive member to an external driving force, said leaf spring inducing said reciprocating axial movement into said drive member and providing a second spring bias force;

whereby, said first spring bias force and said second spring bias force operate in opposite directions over a majority of a range of motion of said drive member such that a total amount of torque required by said external driving force to move said plate is substantially reduced.

20. The tuning apparatus of claim 19, wherein said guide means further comprises:

a diaphragm coupling a first portion of said drive member to a housing; and a bellows coupling a second portion of said drive member to said housing.

21. The tuning apparatus of claim 19, wherein said external driving force comprises:

motor means for producing a rotational motion; and crankshaft means coupled between said motor means and said leaf spring for converting said rotational motion into said reciprocating axial movement.

22. The tuning apparatus of claim 21, wherein said crankshaft means further comprises:

a crankshaft receiving said rotational motion and having a crank arm offset from an axle of said motor means; and a yoke engaging said crank arm and connecting to said linkage means, said rotational motion of said crankshaft being converted to a circular motion of said yoke.

23. The tuning apparatus of claim 22, further comprising:

adjustment means coupled to said crankshaft means for adjusting said range of motion of said drive member.

24. The tuning apparatus of claim 23, wherein said adjustment means further comprises:

a bearing mount disposed between said yoke and said crank arm and having a cam surface; and a screw engaging said bearing mount and having an exposed portion accessible from external to said yoke, said screw being capable of rotating said bearing mount relative to said yoke to alter a position of said crank arm within said yoke.

* * * * *